US006379463B1

(12) United States Patent
Kelley et al.

(10) Patent No.: US 6,379,463 B1
(45) Date of Patent: Apr. 30, 2002

(54) WEB COATING MATERIAL SUPPLY APPARATUS AND METHOD

(75) Inventors: John Kelley, Euless; David Watts, Midlothian, both of TX (US)

(73) Assignee: Royse Manufacturing Co., Dallas, TX (US)

( * ) Notice: Subject to any disclaimer, the term of this patent is extended or adjusted under 35 U.S.C. 154(b) by 0 days.

(21) Appl. No.: 09/422,845

(22) Filed: Oct. 21, 1999

Related U.S. Application Data

(60) Provisional application No. 60/105,360, filed on Oct. 23, 1998.

(51) Int. Cl.[7] ..... B05C 11/00

(52) U.S. Cl. ..... 118/666; 118/692; 118/263; 118/264; 118/258

(58) Field of Search ..... 118/249, 263, 118/501, 264, 261, 262, 688, 692, 693, 258, 666

(56) References Cited

U.S. PATENT DOCUMENTS

| | | | | |
|---|---|---|---|---|
| 4,821,672 A | | 4/1989 | Bruno | 118/261 |
| 4,964,090 A | | 10/1990 | McCarthy | 367/162 |
| 5,075,128 A | | 12/1991 | Gnuechtel et al. | 427/8 |
| 5,425,809 A | | 6/1995 | Person | 118/264 |
| 5,443,639 A | | 8/1995 | Hawkes | 118/224 |
| 5,487,300 A | | 1/1996 | Brackett et al. | 73/61.59 |
| 5,564,913 A | | 10/1996 | Lee | 417/397 |
| 5,628,827 A | | 5/1997 | McCollan et al. | 118/695 |
| 5,750,186 A | * | 5/1998 | Frazzitta | 427/8 |

FOREIGN PATENT DOCUMENTS

| | | |
|---|---|---|
| EP | 0 574 124 A1 | 12/1993 |
| GB | 2 077 629 A | 12/1981 |

OTHER PUBLICATIONS

ISR for PCT/EP99/24891; Completed on May 12, 2000.

* cited by examiner

*Primary Examiner*—Richard Crispino
*Assistant Examiner*—Yewebdar T. Tadesse
(74) *Attorney, Agent, or Firm*—Jenkins & Gilchrist PC

(57) ABSTRACT

A web coating apparatus having a partially submerged drum in a tray of coating material. The drum rotates and transfers coating material from the tray to a web material passing over the drum. A control system carefully controls the level of the coating material in the tray using an ultrasonic fluid level sensor in combination with a programmable system that can add or remove coating material to or from the tray.

6 Claims, 5 Drawing Sheets

WEB COATING MATERIAL SUPPLY APPARATUS AND METHOD

CROSS REFERENCE TO RELATED APPLICATIONS

This application claims priority from provisional application Ser. No. 60/105,360, filed Oct. 23, 1998.

BACKGROUND OF THE INVENTION

1. Field of the Invention

The present invention relates to a web coating apparatus, and more particularly to coating material supply systems and methods for web coating apparatuses used in the printing industry.

2. Description of Related Art

In web coating apparatuses, a coating and drum is partially submerged in a tray of coating material. The coating drum rotates and the coating material is deposited from a surface of the coating drum to the web passing there over. A level detector having two electrodes senses when the level of coating material in the tray reaches predetermined levels. As the drum deposits coating material on the web, the quantity of coating material in the tray is depleted. When the quantity of coating material in the tray is depleted such that the level drops below the predetermined point, a pump draws a coating material from a coating reservoir and deposits the coating material into the tray. When the pump deposits sufficient quantity of the coating fluid into the tray to bring the level of coating fluid in the tray up to the predetermined level, the sensor senses the existence of the coating fluid at the predetermined level and shuts off the coating supply pump.

There are a few drawbacks of this technique. One drawback is that coating or printing quality may change due to varying levels of coating material in the transfer pan. Furthermore, since the coating material is exposed to air in the transfer pan, its viscosity may change over time resulting in varying coating or printing quality. Thus, there is a need for a system that can accurately control the level of coating material in the transfer pan and further disallow the coating material from significantly changing viscosity over time.

SUMMARY OF THE INVENTION

The present exemplary embodiments of the present invention provide a coating material supply system which may accurately control the level of coating material in a transfer pan of a coating tower of a printing system. An exemplary embodiment may both provide and remove coating material, such as UV coatings, aqueous varnishes, inks, or other fluids, to and from a transfer tray or chamber in order to maintain a substantially uniform level, pressure, temperature, or viscosity of the coating material.

An exemplary web coating apparatus that provides coating material which coats a web material as it moves past a coating drum includes a transfer pan or chamber for holding coating material that is being transferred from the transfer pan to the coating drum. The coating drum is partially submerged in the coating material. A coating supply system provides and removes coating material from the transfer pan. An ultrasonic level sensor measures the coating material level in the transfer pan and provides information to the coating supply system so that coating material is being supplied and removed from the transfer pan at rates that keeps the level of coating material in the transfer pan substantially unchanging.

The continuous supply and removal of coating material from the transfer pan also aids in keeping the viscosity and temperature of the coating material more uniform during a printing or coating process.

BRIEF DESCRIPTION OF THE DRAWINGS

Various objects and advantages of the invention will become apparent and more readily appreciated from the following description of the presently preferred exemplary embodiments, taken in conjunction with the accompanying drawings, of which.

DETAILED DESCRIPTION OF THE PRESENTLY PREFERRED EXEMPLARY EMBODIMENTS OF THE PRESENT INVENTION

Figure 1:
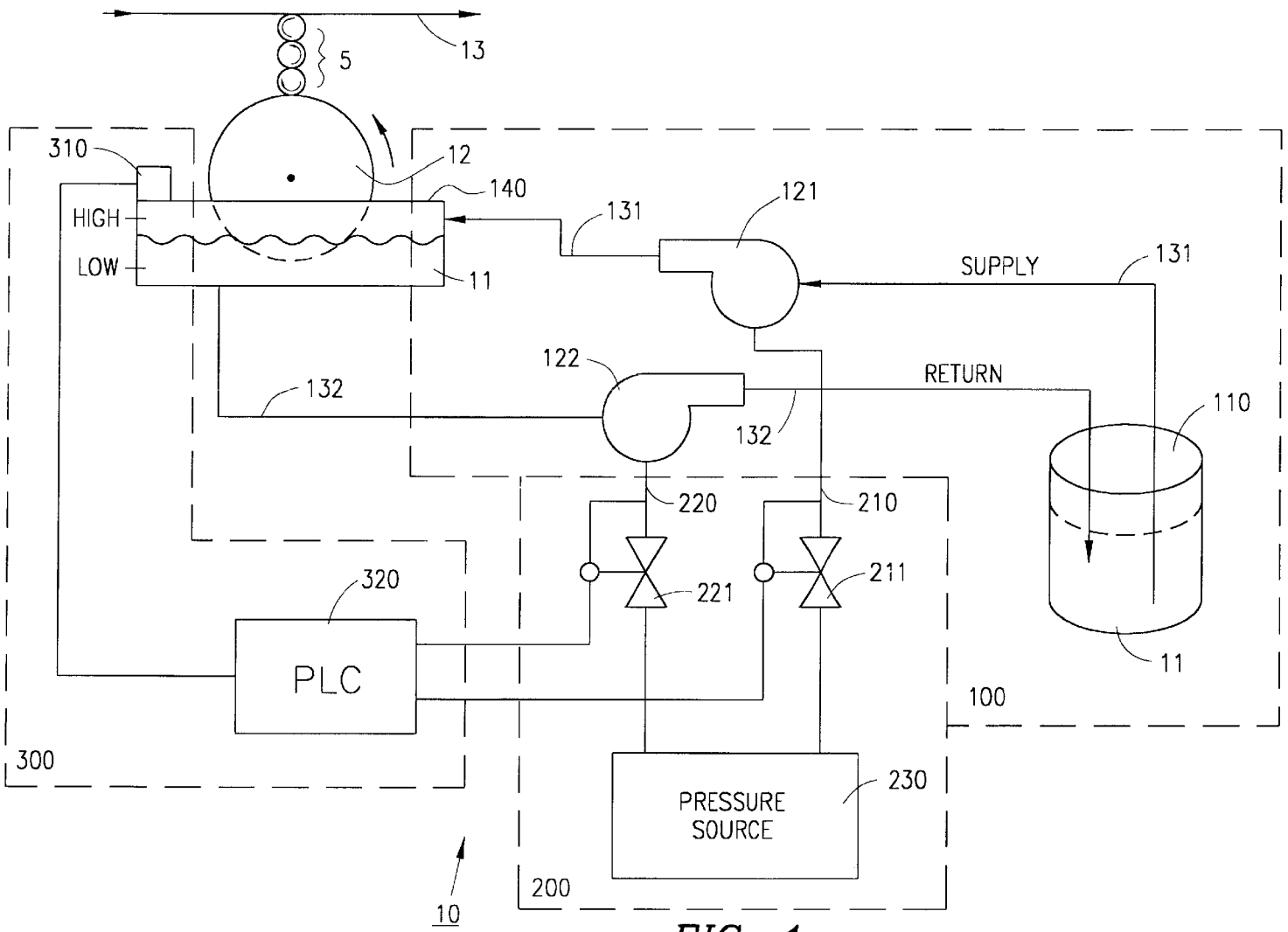
FIG. 1 is a diagram illustrating an exemplary coating material supply apparatus for a coating or printing system.
Figure 2:
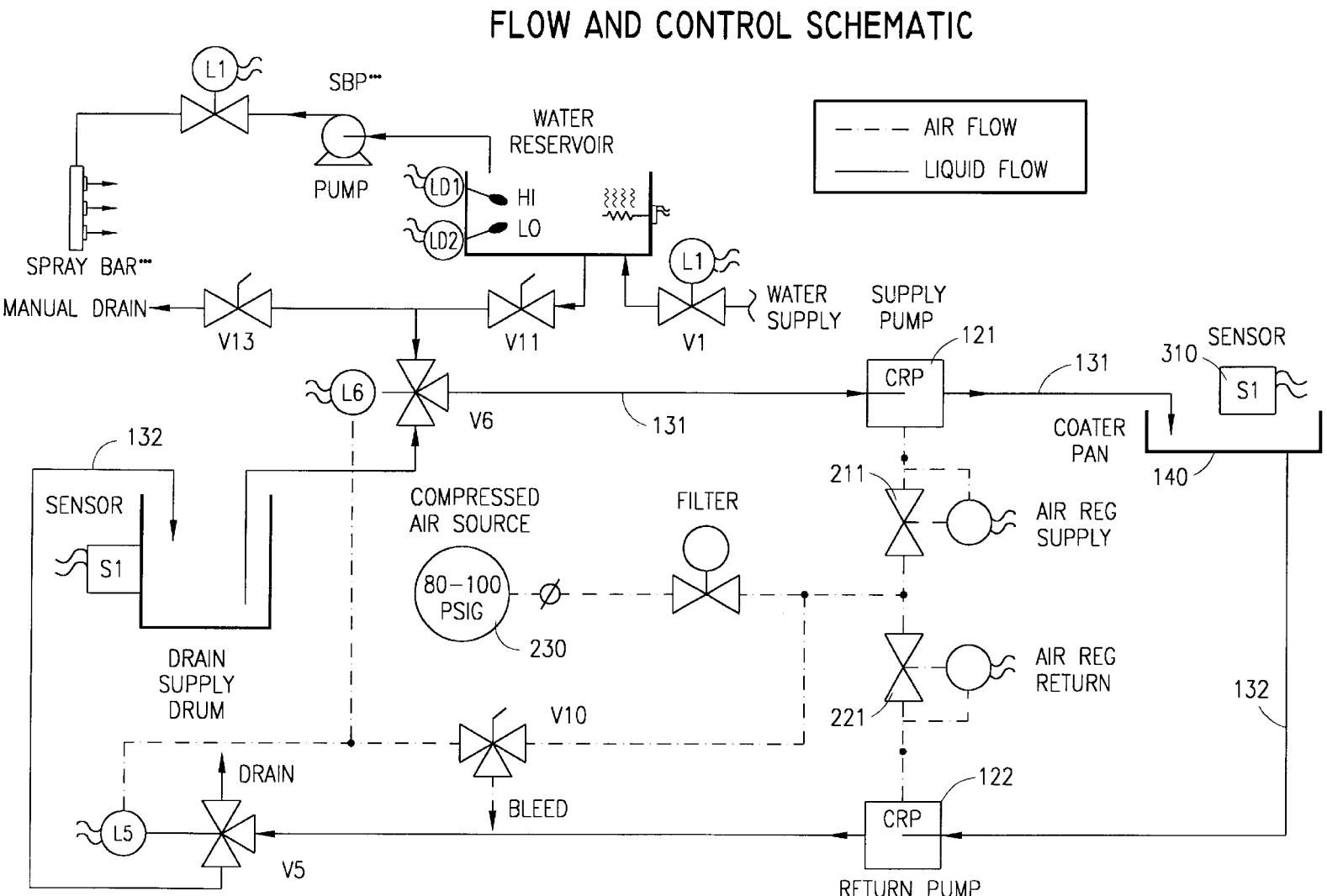
FIG. 2 is a diagram illustrating another exemplary coating material supply apparatus for a coating or printing system.

Referring now to the drawings, and in particular to FIGS. 1 and 2, there are shown exemplary schematic drawings of a coating material supply system 10 embodying the present invention. The coating material supply system 10 provides a coating material 11 to a coating drum 12 for application to a web 13. The coating material supply system 10 generally comprises a coating material transfer system 100, a power system 200, and a control system 300.

The coating material transfer system 100 includes a coating material reservoir 110, a supply line 131 with a supply pump 121, a return line 132 with a return pump 122, and a transfer pan 140. The supply pump 121 draws coating material 11 from the coating material reservoir 110 and supplies the coating material to the transfer pan 140 through the supply line 131. The return pump 122 draws coating material 11 from the transfer pan 140 and deposits the coating material 11 into the coating material reservoir 110 through the return line 132. In a preferred embodiment, the supply pump 121 and the return pump 122 are driven by air pressure motors. The return and supply pumps are preferably a diaphram style pump that is driven by air pressure. An equivalent pump would be one that is self priming and one that can pump fluids or air without stalling. In particular the return pump must be able to handle air pockets or bubbles in the return line.

The power system 200 includes a supply power line 210 with a supply power pressure regulator 211, a return power line 220 with a return power pressure regulator 221, and a pressure source 230. In one embodiment, the supply power pressure regulator 211 and the return power pressure regulator 221 are electronic air regulators. The supply power line 210 provides drive pressure (such as compressed air) from the pressure source 230 to the supply pump 121 for driving the supply pump 121. The return power line 220 provides drive pressure (such as from compressed air) from the pressure source 230 to the return pump 122 for driving the return pump 122. Although the pressure source 230 is illustrated as a single source for both the supply power line 210 and the return power line 220, the present invention contemplates that the pressure source 230 can be individual or separate pressure sources for the supply power line 210 and the return power line 220.

The supply power pressure regulator 211 controls the drive pressure from the pressure source 230 to the supply pump 121. As the supply power pressure regulator 211 increases the drive pressure to the supply pump 121, the supply pump 121 increases the flow of coating material 11 from the coating material reservoir 110 to the transfer pan 140. As the supply power pressure regulator 211 decreases the drive pressure to the supply pump 121, the supply pump 121 decreases the flow of coating material 11 from the coating material reservoir 110 to the transfer pan 140.

The return power pressure regulator 221 controls the drive pressure from the pressure source 230 to the return pump 122. As the return power pressure regulator 221 increases the drive pressure to the return pump 122, the return pump 122 increases the flow of coating material 11 from the transfer pan 140 to the coating material reservoir 110. As the return power pressure regulator 221 decreases the drive pressure to the return pump 122, the return pump 122 decreases the flow of coating material 11 from the transfer pan 140 to the coating material reservoir 110.

The control system 300 includes a level sensor, preferably an ultrasonic level sensor 310, and a programmable logic controller (PLC) 320. The ultrasonic level sensor 310 determines when the coating material 11 in the transfer pan 140 reaches a "high" level or a "low" level, and communicates that finding to the PLC 320. The PLC 320 controls the supply power pressure regulator 211 and the return power pressure regulator 221 in response to the high or low level determination by the ultrasonic level sensor 310.

FIG. 2 depicts another exemplary schematic diagram illustrating another embodiment of the present invention. The diagram is slightly more detailed than FIG. 1 and discloses additional bleed and drain valves for removing clogs, air or mixing water or other solvent into the coating material within the coating material reservoir 110.

Figure 3:
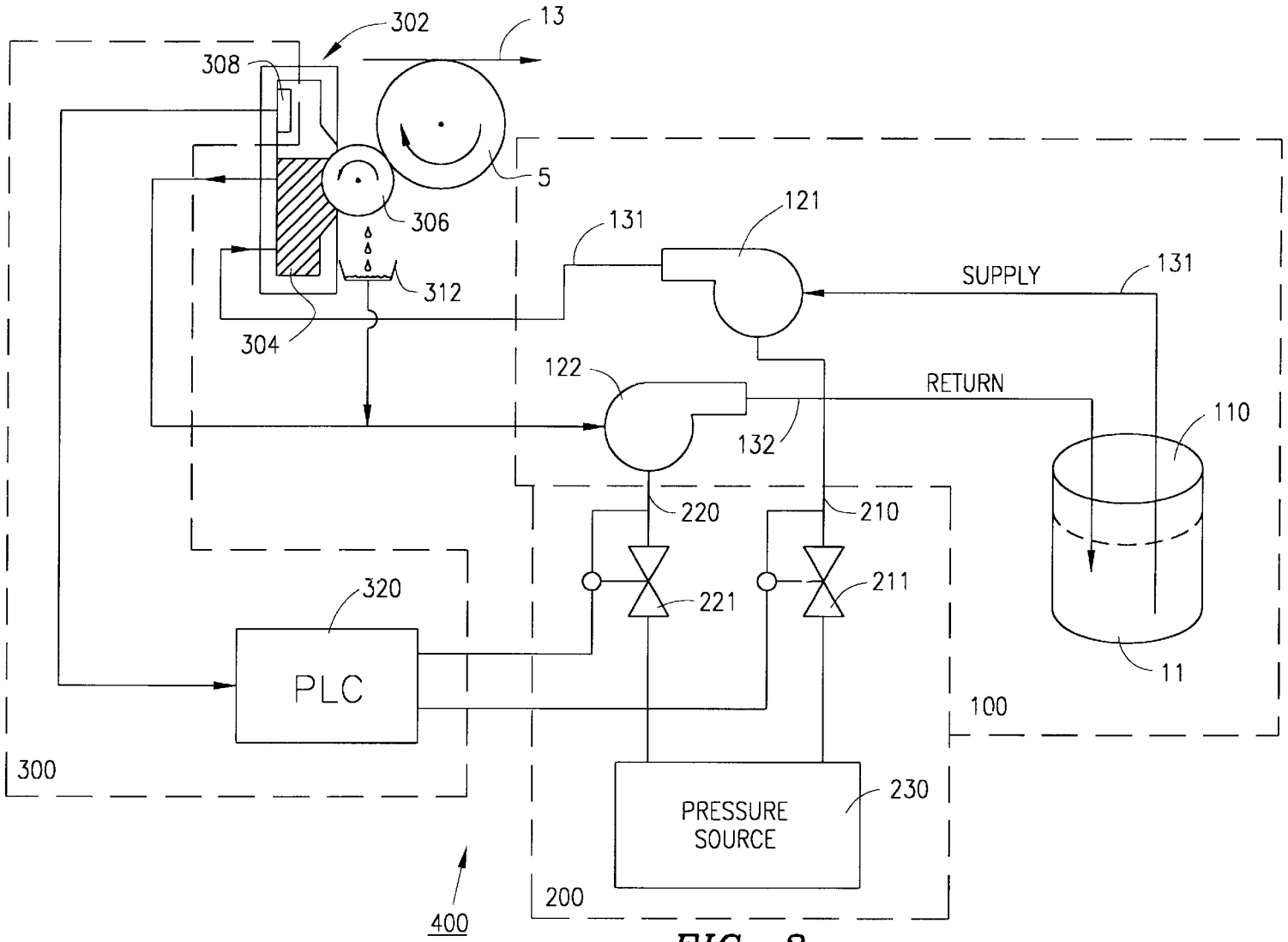
FIG. 3 is a diagram illustrating another exemplary coating material supply apparatus for a coating or printing system.

FIG. 3 depicts another exemplary diagram illustrating another embodiment of the present web coating material supply system within a printing system 400. This coating material transfer system 400 is similar to the system discussed in FIG. 1 except that a chamber 302 is used which encloses coating material 304. A first roller 306 rotates against the chamber 302 so that coating material 304 is transferred from within the chamber 302 to the first roller 306.

The supply pump 121 and return pump 122 operate to supply and remove coating material 304 to and from the chamber 302. By both supplying and removing coating material from the chamber the temperature, viscosity and pressure of the coating material against the first roller 306 can be maintained relatively constant. By keeping one or more of these factors constant the coating or printing quality of the press can be kept relatively constant.

A sensor 308 may measure the pressure or vacuum in the chamber 302 and provide information to the PLC 320 for control of the pumps 121 and 122. As such coating material 304 can be moved through the chamber 302 while maintaining a constant coating material pressure against the first roller 306. A high flow of coating material through the chamber may be used when the press is operating at high volumes so as to keep the coating material from heating up outside of a predetermined range within the chamber. Thus, as the press speed increases, the flow of coating material through the chamber may increase to both supply and additional coating needs of the press and to remove coating material from the chamber before it exceeds a predetermined temperature.

It is noted the sensor 308 may also include a temperature sensor so as to provide temperature information to the PLC 320.

A drip tray 312 is used to catch overflow or drips from the first roller 306. The coating material is removed from the drip tray 312 with positive suction provided by the return pump 122.

Figure 4:
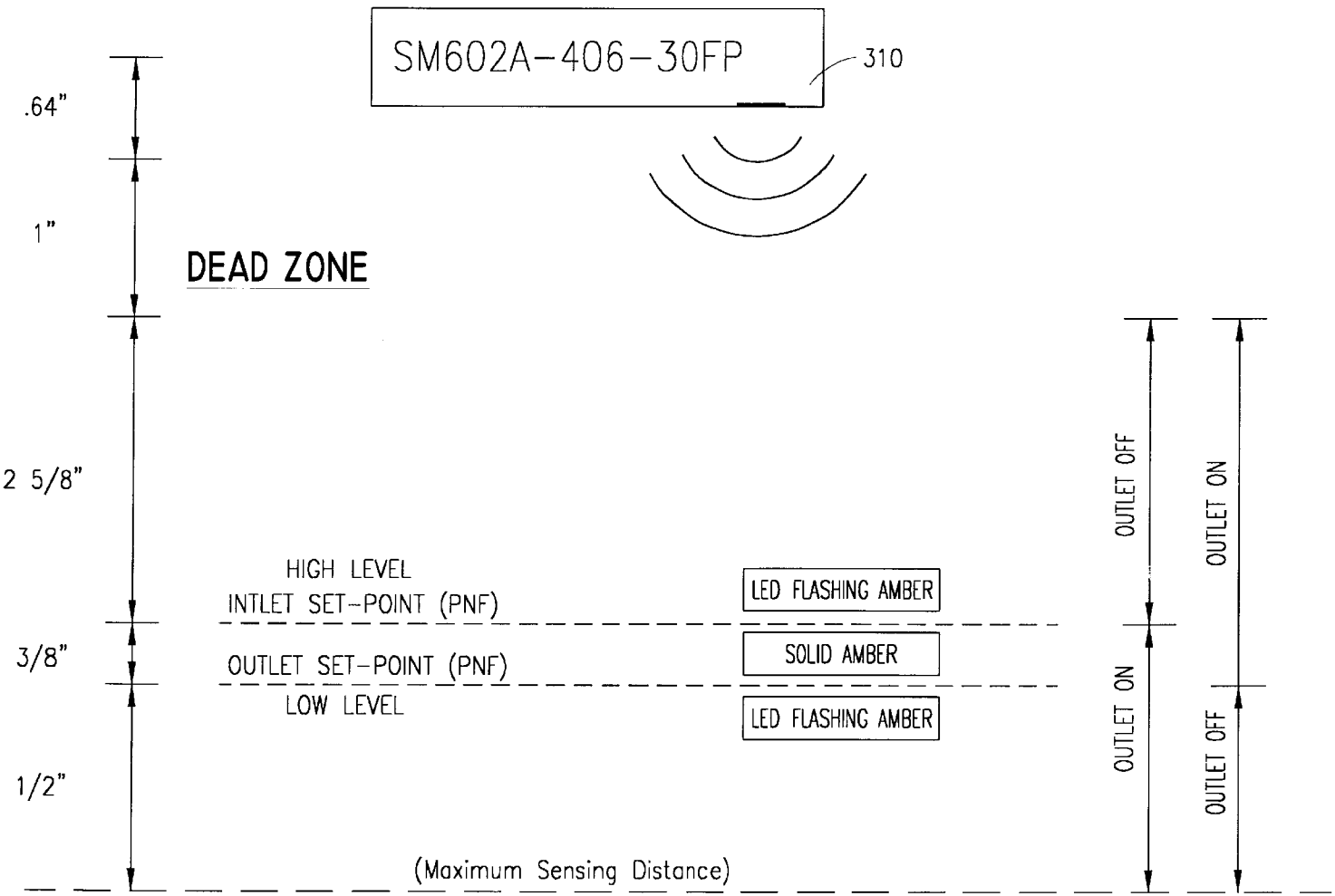
FIG. 4 depicts an exemplary ultrasonic sensor used in accordance with an embodiment of the present invention.
Figure 5:
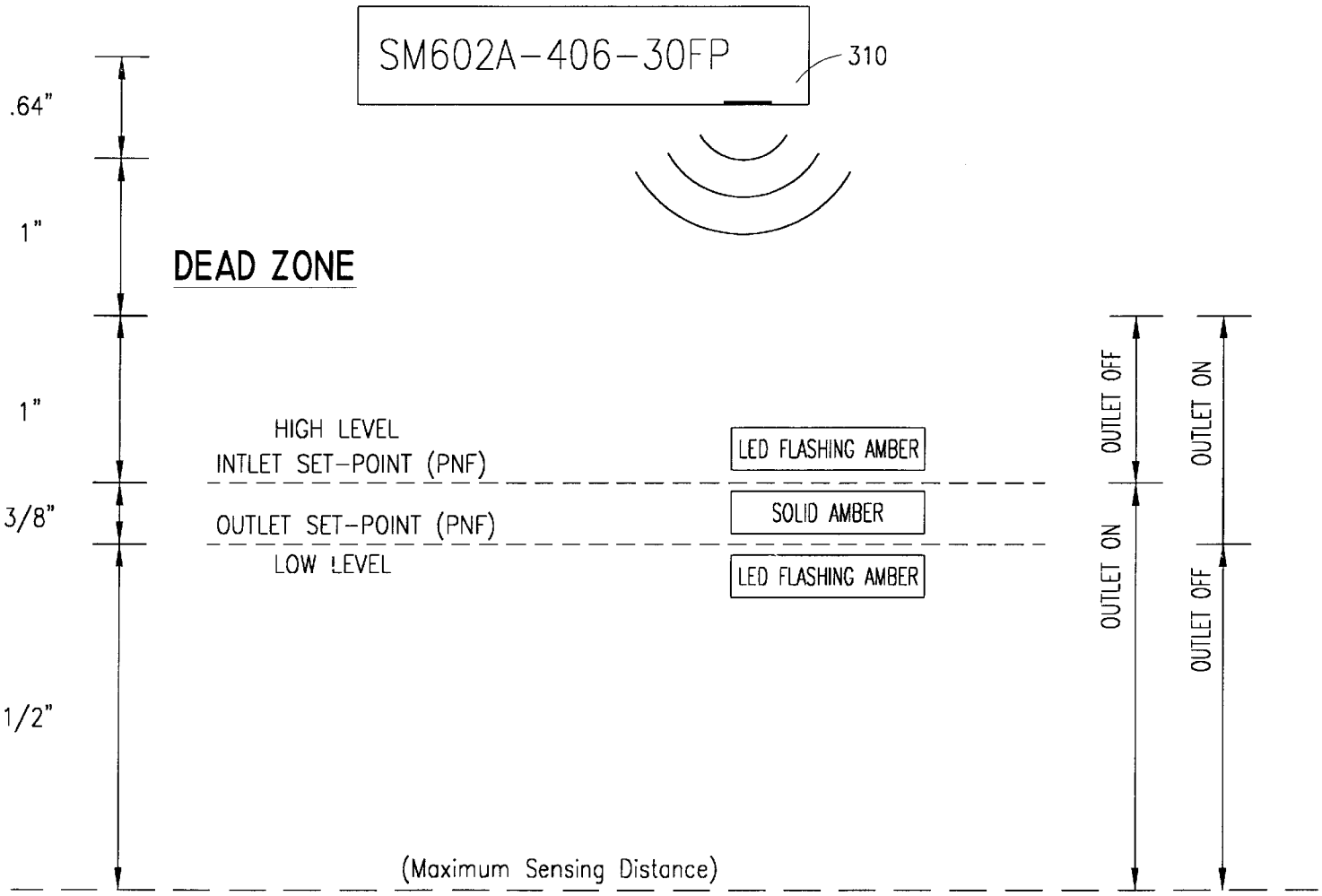
FIG. 5 depicts an exemplary ultrasonic sensor for use in accordance with an exemplary embodiment of the present invention.

FIGS. 4 and 5 depict exemplary ultrasonic sensors 310 and the accuracy of the level of coating material that can be sensed. The exemplary ultra sonic sensors can accurately detect and measure fluid level changes of less than three-eighths (⅜) of an inch. This accuracy can aid the coating material supply system to maintain a substantially level amount of coating material 11 in the transfer pan 140. This is extremely important so that the coating drum is submerged substantially the same distance in the coating material 11 and thereby provide a substantially uniform amount of coating material to the web 13. An advantage of using the exemplary ultrasonic level sensor is that splashing and caking of the coating material do not affect the accuracy of the measurements made by the ultrasonic sensor 310. In essence, the ultrasonic sensor provides a higher degree of reliability over probe, floating, or optical sensors. It further provides measurement accuracy that is difficult to achieve with other sensors.

Referring back to FIGS. 1 and 2, if the level of the coating material 11 in the transfer pan 140 reaches the high level, the PLC 320 will adjust the supply power pressure regulator 211 to reduce the drive pressure from the pressure source 230 to the supply pump 121 without a momentary stop of the supply pump 121. In one preferred embodiment, the PLC's 320 adjustments of the supply power pressure regulator 211 which reduce the drive pressure from the pressure source 230 to the supply pump 121 are made in a predetermined increment, such as one PSI. In yet another embodiment, the PLC 320 will also react to the high level determination by the ultrasonic sensor 310 by adjusting the return power pressure 221 to increase the drive pressure from the pressure supply 230 to the return pump 122, thereby increasing the pumping rate of the return pump 122 and increasing the flow rate of coating material 11 to the coating material reservoir 110 from the transfer tray 140. In the manner set forth in these embodiments, the return pump 122 will pull some of the coating material 11 from the transfer pan 140 and the supply pump 121 will reduce the rate at which coating material 11 is supplied to the transfer pan 140 in an attempt to maintain the level of the coating material 11 in the transfer pan 140 below the high level. The PLC 320 will repeat these procedures to reduce the level of coating material 11 in the transfer pan 140 until a predetermined time period, such as three seconds, passes without the ultrasonic sensor 310 determining that a high level exists in the transfer pan 140.

If the ultrasonic sensor 310 determines that the level of the coating material 11 in the transfer pan 140 is above the high level for a predetermined time period, such as three seconds, the PLC 320 will adjust the supply power pressure regulator 211 to shut off the pressure supply 230 from the supply pump 121 until the ultrasonic sensor 140 determines that the high level condition in the transfer pan 140 no longer exists. In this manner, the supply pump 121 will stop providing coating material 11 to the transfer tray 140, allowing the return pump 122 to draw the coating material 11 from the transfer pan 140 and reduce the level of coating material 11 in the transfer tray 140. In a preferred embodiment, the PLC will also reduce the drive pressure from the pressure supply 230 to the supply pump 121, such as by a predetermined increment of pressure (e.g. one PSI), thereby reducing the flow rate of coating material 11 to the transfer pan 140 and inhibiting addition high level conditions. In another embodiment, the PLC 320 will also adjust the return power pressure regulator 220 to increase the drive pressure from the pressure source 230 to the return pump 122, thereby increasing the pumping rate of the return pump 122 and increasing the flow rate of coating fluid 11 from the transfer tray 140 to the coating material supply 110 and reducing the level of the coating material 11 in the transfer pan 140 at a greater rate.

If the level of the coating material 11 in the transfer pan 140 reaches the low level and the drive pressure to the return pump 122 is greater than a predetermined minimum return pressure (such as 22 PSI), the PLC 320 will adjust the return power pressure regulator 221 to reduce the drive pressure from the pressure source 230 to the return pump 122 without the momentary stop of the return pump 122. In one preferred embodiment, the adjustments by the PLC 320 of the return power pressure regulator 221 to reduce the drive pressure from the pressure source 230 to the return pump 122 are made in a predetermined increment, such as one PSI. In this manner, the return pump 122 will reduce the rate at which coating material 11 is taken from the transfer pan 140 in an attempt to maintain the level of the coating material 11 in the transfer pan 140 above the low level. The PLC 320 will repeat this procedure to increase the level of coating material 11 in the transfer pan 140 until a predetermined time period, such as three seconds, passes without the ultrasonic sensor 310 determining that a low level exists in the transfer pan 140 or until the drive pressure to the return pump 122 reaches the predetermined minimum return pressure.

If the level of the coating material 11 in the transfer pan 140 reaches the low level and the drive pressure to the return pump 122 is equal to or less than the predetermined minimum return pressure, the PLC 320 will adjust the supply power pressure regulator 211 to increase the drive pressure from the pressure supply 230 to the supply pump 121, thereby increasing the pumping rate of the supply pump 121 and increasing the flow of coating material 11 to the transfer tray 140. In one preferred embodiment, the adjustments by the PLC 320 of the supply power pressure regulator 211 to increase the drive pressure from the pressure source 230 to the supply pump 121 are made in a predetermined increment, such as one PSI. In this manner, the supply pump 121 will increase the rate at which coating material 11 is added to the transfer pan 140 in an attempt to maintain the level of the coating material 11 in the transfer pan 140 above the low level. The PLC 320 will repeat this procedure to increase the level of coating material 11 in the transfer pan 140 until a predetermined time period, such as three seconds, passes without the ultrasonic sensor 310 determining that a low level exists in the transfer pan 140.

If the ultrasonic sensor 310 determines that the level of the coating material 11 in the transfer pan 140 is below the low level for a predetermined time period, such as three seconds, and the drive pressure to the return pump 122 is above the predetermined minimum return pressure, the PLC 320 will adjust the return power pressure regulator 221 to shut off the pressure supply 230 from the return pump 122 until the ultrasonic sensor 140 determines that the low level condition in the transfer pan 140 no longer exists. In this manner, the return pump 122 will stop removing coating material 11 from the transfer tray 140, allowing the supply pump 121 to add the coating material 11 to the transfer pan 140 and increase the level of coating material 11 in the transfer pan 140. In a preferred embodiment, the PLC will also either adjust the adjust the return power pressure regulator 221 to reduce the drive pressure from the pressure supply 230 to the return pump 122 if the resulting drive pressure to the return pump 122 is higher than the predetermined minimum return pressure, or, adjust the supply power pressure regulator 211 to increase the drive pressure from to the supply pump 121 if the drive pressure to the return pump 122 is equal to or less than the predetermined minimum return pressure. In a further embodiment, the reduction of drive pressure to the return pump 122 or increase of drive pressure to the supply pump 121 is a predetermined increment of pressure such as one PSI.

Ultrasonic sensing allows sensing without making contact with the coating material. Thus, the coating material does not coat the ultrasonic sensor and thus, limits the amount of sensor cleaning required.

Furthermore, the present exemplary embodiments allow a single sensor to control both the high and low levels of the coating material in the tray without contact with the material. If only high level sensing is used, the level of coating material may become too low thereby allowing the system to run dry.

Another advantage of the present exemplary invention embodiments is that by using the air pressure regulators 221 and 211, the pressure of both pumps can be operated individually thereby providing more flow variation in the system. One pump can be operating at a higher pressure or lower pressure than the other thereby providing various techniques of controlling the coating material level in the tray. The combination of pumps and ultrasonic level sensing allows the coating material to continuously move in the system thereby clogging of dried material is kept to a minimum, the level in the tray can be accurately controlled, and viscosity can be kept within predetermined parameters.

Furthermore, if for any reason the viscosity of the coating material in the system 10 changes, the pump pressure can be adjusted by the PLC based on level changes in the tray.

Although various preferred embodiments of the invention have been shown and described, it will be appreciated by those skilled in the art that changes may be made to these embodiments without departing from the principles and the spirit of the invention, the scope of which is defined in the appended claims.

What is claimed is:

1. A coating apparatus for providing a continuous flow of coating material to and from a chamber, said apparatus comprising:

a chamber for holding a coating material substantially against a first roller;

a sensor for determining a predetermined condition inside said chamber;

a supply system adapted to variably supply coating material to said chamber when said apparatus is in operation;

a return system adapted to variably remove said coating material from said chamber when said apparatus is in operation; said combination of said supply system and said return system operating to establish a predetermined pressure in said chamber and a flow of said coating material through said chamber;

a programmable control device that receives condition information from said sensor and further provides control signals to said supply system and return system.

2. The coating apparatus of claim 1, wherein said sensor is a pressure sensor.

3. The coating apparatus of claim 1, wherein said sensor is a temperature sensor.

4. The coating apparatus of claim 1, wherein said coating material is ink.

5. A coating apparatus for providing a continuous flow of coating material to and from a chamber, said apparatus comprising:

a chamber for holding a coating material substantially against a roller;

a temperature sensor for sensing the temperature of the coating material inside the chamber;

a supply system for variably supplying coating material to the chamber;

a return system for variably removing coating material from the chamber; the combination of the supply system and the return system operating to establish a predetermined pressure in the chamber and a flow of the coating material through the chamber;

a programmable control device that receives temperature information from the sensor and further provides control signals to the supply system and the return system to control the flow rate of the coating material through the chamber.

6. The coating apparatus of claims 5 wherein the sensor includes a pressure sensor and wherein the programmable control device receives pressure information from the sensor and further provides control signals to the supply system to control the pressure of the coating material in the chamber.

* * * * *